United States Patent [19]

Mathys

[11] 4,117,664

[45] Oct. 3, 1978

[54] PIVOTING DEVICE FOR A WATCH BARREL

[75] Inventor: Pierre Mathys, Begnins, Switzerland

[73] Assignee: Bouchet-Lassale S.A., Geneva, Switzerland

[21] Appl. No.: 764,685

[22] Filed: Feb. 1, 1977

[30] Foreign Application Priority Data

Feb. 18, 1976 [CH] Switzerland ..... 1963/76
Oct. 12, 1976 [CH] Switzerland ..... 12861/76

[51] Int. Cl.[2] ..... G04B 1/16
[52] U.S. Cl. ..... 58/86; 58/59
[58] Field of Search ..... 58/59, 73, 80, 82 R, 58/86

[56] References Cited

U.S. PATENT DOCUMENTS 3,142,955 8/1964 Fiechter ..... 58/86 X

FOREIGN PATENT DOCUMENTS 334,702 1/1959 Switzerland ..... 58/86
2,137 of 1910 United Kingdom ..... 58/86

*Primary Examiner*—Stanley J. Witkowski
*Attorney, Agent, or Firm*—Young & Thompson

[57] ABSTRACT

The invention relates to a pivoting device for the barrel of a thin watch which comprises at least three rollers pivoted on miniature ball bearings and engaging with the periphery of the barrel.

6 Claims, 5 Drawing Figures

PIVOTING DEVICE FOR A WATCH BARREL

The present invention relates to a new pivoting device for a barrel or spring-drum of a clock movement, more particularly a watch movement. This device constituting the invention is characterised by the fact that it has at least three small wheels or rollers pivoted on miniaturized ball bearings and engaging with the periphery of the spring-drum.

The attached drawing shows diagrammatically and by way of example an embodiment of the pivoting device in accordance with the invention.

Figure 1:
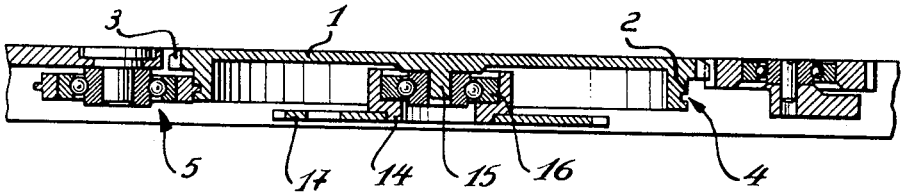
FIG. 1 is a sectional view of the same.
Figure 2A:
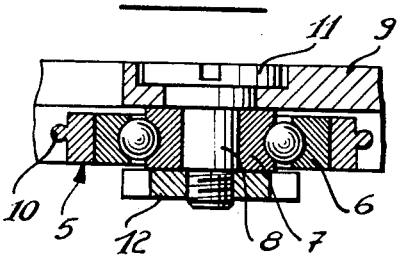
FIGS. 2A and 2B are sectional views through two pivoting wheels.
Figure 2B:
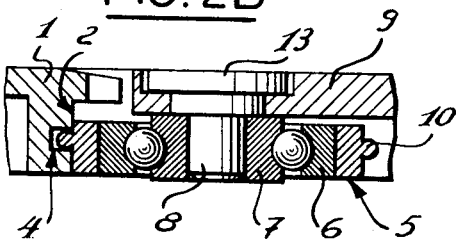
Figure 3:
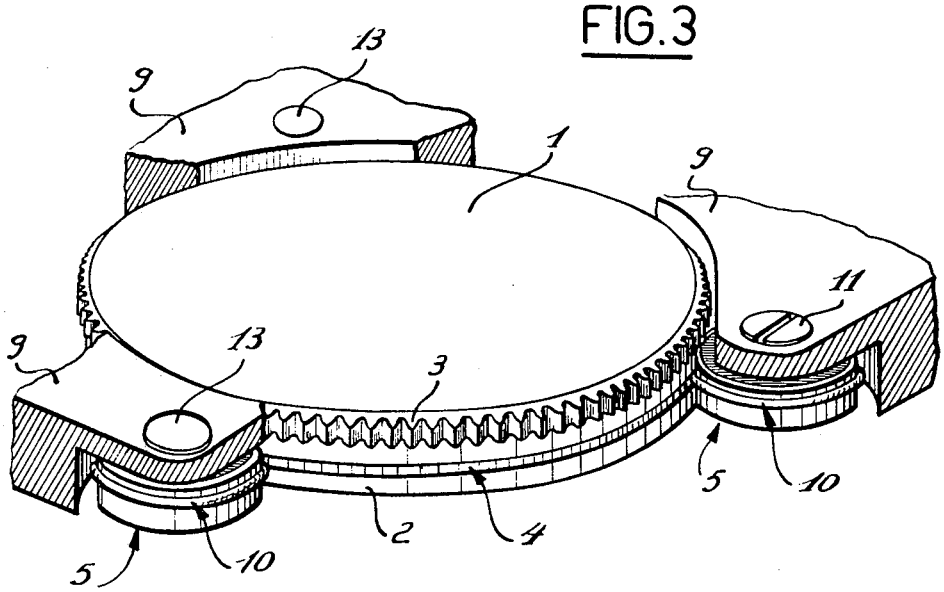
FIG. 3 is a general perspective view of a spring-drum pivoted on three small wheels.

As indicated with reference to FIGS. 1 through 3, the barrel or spring-drum 1 has a cage 2 the periphery of which is provided firstly with toothing 3 and secondly with a circular groove 4. This circular groove 4 engages with three small wheels or rollers 5, each small wheel 5 being pivoted on a ball bearing 6 the inner cage 7 of which is driven onto a spindle 8 which is itself secured to the plate 9 of the watch. The outer cage of these ball bearings 6 exhibits a circular flange 10 which engages in the groove 4 of the cage 2 of this spring-drum.

One of the small wheels 5 is mounted on the plate 9 so as to be detachable, for instance with the aid of a bolt 11 and a nut 12 (FIG. 2A), this in order to allow location or replacement of the spring-drum 1. The other two small wheels 5 are permanently fixed on the plate 9 for example by means of rivets 13 driven into this plate 9 (FIG. 2B).

Figure 2C:
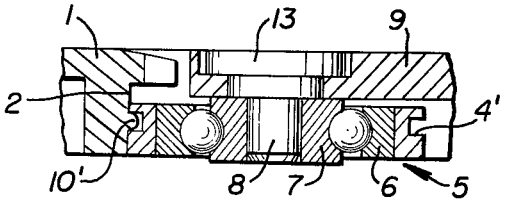
FIG. 2C is a view similar to FIG. 2B but showing a modified embodiment.

In other forms of embodiment of the pivoting device in accordance with the invention (not shown) the spring-drum can be pivoted on four or more small wheels and the means by which the small wheels engage with the periphery of the spring-drum can be different; for instance, as shown in FIG. 2C, one could provide a flange 10' on the periphery of the spring-drum and a groove 4' on that of the small wheels.

As shown in FIG. 1, the actual drum 14 of the spring-drum is pivoted on the spring-drum spindle 15 with the aid of a ball bearing 16. The spring-drum ratchet 17 can also be pivoted on the centre of the spring-drum 1.

Thus, with the spring-drum 1 pivoted and supported at its periphery, the entire height of the movement is available for the spring-drum ratchet 17 and the spring-drum 1 itself. Thus the maximum amount of height can be allowed for the actual drum 14 of the spring-drum 1, this making it possible to use a spring which is also of maximum width so as to obtain a greater working reserve for the movement.

It is quite acceptable that the spring-drum pivoting device in accordance with the invention can be incorporated into any type of watch movement whether manually or automatically wound, in which the moving parts are pivoted in a conventional manner or in which one or more wheels or rotatable or swingable elements in the time-piece are pivoted in an overhanging or cantilevered position as described in Swiss patent application No. 1,963/76 filed by the same applicant.

The essential advantage of the spring-drum pivoting device in accordance with the invention thus lies in the fact that it makes it possible to have a maximum height for the actual drum 14 of the spring-drum 1 and thus firstly to produce extra-thin time-pieces and to obtain a greater working reserve through the incorporation of a wider spring.

Naturally the expert in the art could effect various modifications to the device that has just been described solely by way of a non-limitative example without going beyond the bounds of the invention.

What we claim is:

1. A watch having a plate, a barrel having a circular periphery, at least three small wheels that are mounted solely on and rotatable relative to said plate, said wheels being spaced about and engaging said periphery to support said barrel on said plate.

2. A watch as claimed in claim 1, and a miniature ball bearing on which each of said small wheels is mounted for rotation, each said ball bearing comprising an inner cage and an outer cage, said outer cage being secured within the corresponding said small wheel, a spindle for each said small wheel mounted solely at one end of said spindle on said plate, said inner cage being mounted on said spindle.

3. A watch as claimed in claim 1, and a spindle secured at only one end thereof to said barrel coaxially with said barrel, a miniature ball bearing on said spindle, and a spring drum ratchet carried by said ball bearing for rotation on and relative to said spindle.

4. A watch as claimed in claim 1, and means mounting at least one said spindle detachably on said plate.

5. A watch as claimed in claim 1, said periphery having a circular groove therein, each said small wheel having a flange thereon that engages in said groove.

6. A watch as claimed in claim 1, said periphery having a circular flange thereon, each said small wheel having a circular groove in which said flange is engaged.

* * * * *